United States Patent [19]

Corbett

[11] 4,118,969

[45] Oct. 10, 1978

[54] DOUBLE ACTION FASTENER INSTALLATION TOOL FOR BLIND RIVETS AND THE LIKE

[75] Inventor: Robert John Corbett, Saugerties, N.Y.

[73] Assignee: Huck Manufacturing Company, Detroit, Mich.

[21] Appl. No.: 819,495

[22] Filed: Jul. 27, 1977

[51] Int. Cl.[2] ..... B21J 15/34

[52] U.S. Cl. ..... 72/391; 72/453.17

[58] Field of Search ..... 72/391, 114, 453.17, 72/453.02; 29/243.52; 91/412

[56] References Cited

U.S. PATENT DOCUMENTS

| | | | |
|---|---|---|---|
| 2,820,566 | 1/1958 | Van Hecke | 91/412 |
| 3,777,540 | 12/1973 | Siebol | 72/453.17 |
| 3,996,784 | 12/1976 | Champoux | 72/391 |

FOREIGN PATENT DOCUMENTS

| | | | |
|---|---|---|---|
| 2,306,034 | 4/1976 | France | 72/391 |

*Primary Examiner*—C.W. Lanham
*Assistant Examiner*—Gene P. Crosby
*Attorney, Agent, or Firm*—Harness, Dickey & Pierce

[57] ABSTRACT

An improved fluid actuated double action pullgun for installing blind rivets, particularly of the lock spindle type, which includes an improved shift valve mechanism. The shift valve employes a ballseat relief valve associated with pressure responsive plunger mechanism and spring responsive ball guide mechanism which respond to pressure differentials to directly monitor pressure in the trapped oil circuit and restrain "shift piston" motion prior to shift. Premature "shift piston" travel, which is a malfunction, is eliminated.

2 Claims, 13 Drawing Figures

DOUBLE ACTION FASTENER INSTALLATION TOOL FOR BLIND RIVETS AND THE LIKE

BACKGROUND OF THE INVENTION

This invention relates broadly to double action fastener installation tools.

The pertinent prior art is indicated by VanHecke U.S. Pat. No. 2,820,566 and the technical brochure of the Huck Manufacturing Company, entitled, "Instruction Manual, Model 200 Installation Tool," copyrighted under notice 1965, 1975. Both of these disclosures are incorporated herein by reference.

The present application is also related to application Ser. No. 564,078 filed Apr. 1, 1975, and assigned to Huck Manufacturing Company, such application having been abandoned.

The primary object of the present invention is to assure the proper functioning of a double action installation tool by the incorporation of an improved shift valve mechanism so constructed and associated with the oil pressure circuit as to prevent premature actuation of the shift piston.

BRIEF DESCRIPTION OF THE DRAWINGS

FIG. 1 is a longitudinal sectional view of a double acting installation tool embodying the present invention such as the type shown in the VanHecke patent and the Huck Manual referred to;

SUMMARY OF THE INVENTION

The installation tool of the present invention is designed to install a wide range of fasteners requiring a double action installation tool, particularly blind rivets of the lock spindle type. Power, speed and accuracy are obtained through a pneumatic hydraulic intensifier system powered by 90 to 100 PSI air.

The tool consists of three major subassemblies. One is the head assembly which includes a pull piston and a shift piston. The second is a handle and piston assembly which includes the triggering system and the pneumatic and hydraulic pistons. The third is a cylinder assembly which includes an adjustable shift valve mechanism to control precisely the installation of fasteners requiring a double action tool and so constructed and associated with the hydraulic and air power systems that premature shift will not occur. Premature shift causes a malfunction in the installed fastener.

DESCRIPTION OF THE PREFERREED EMBODIMENT AND BEST MODE OF OPERATION

Figure 3:
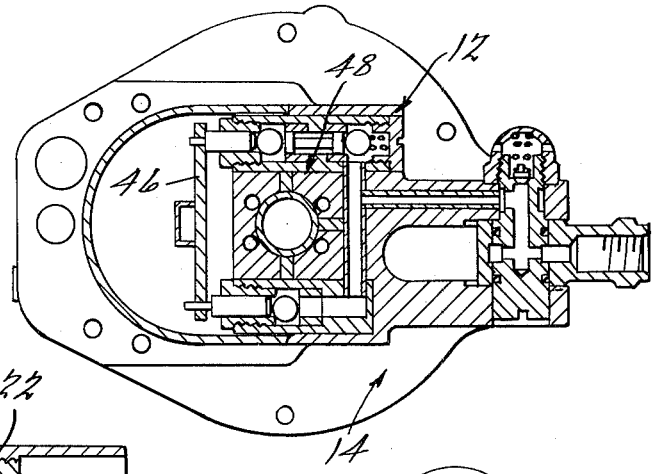
FIG. 3 is a cross sectional view taken substantially along the Line 3—3 of FIG. 1.
Figure 1:
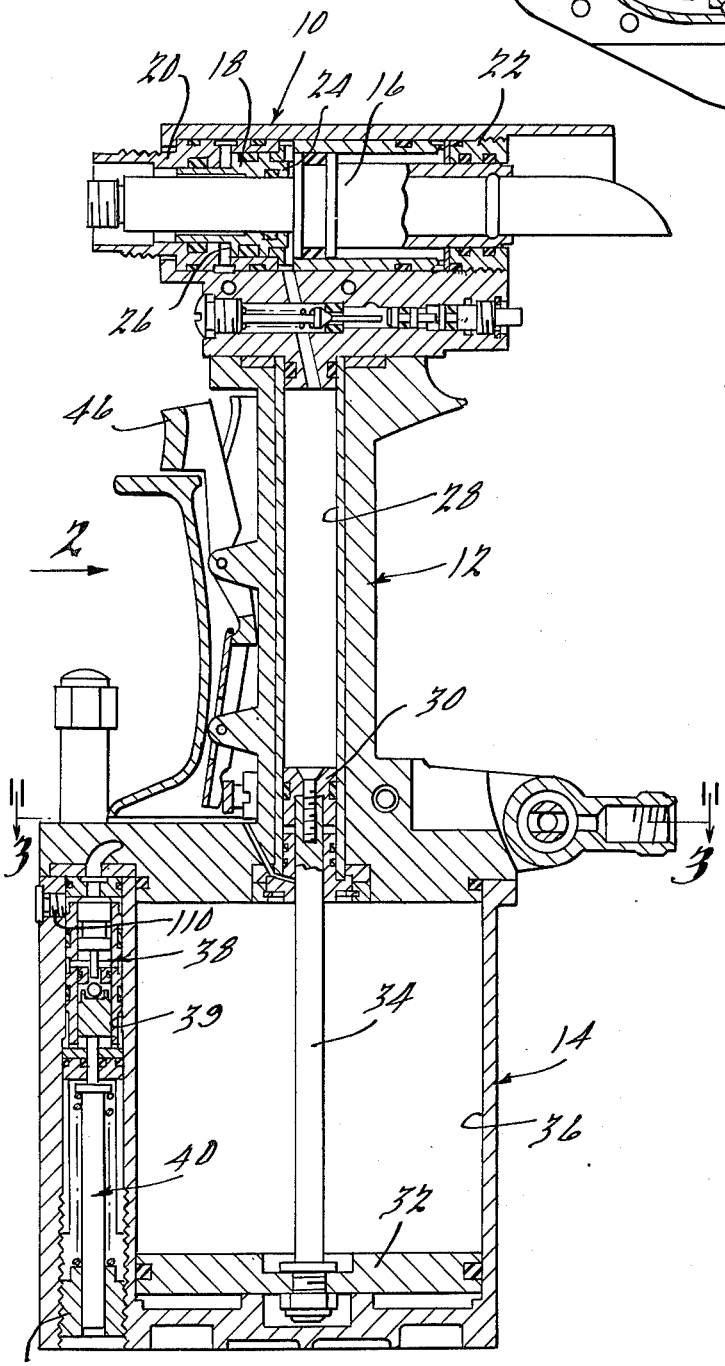
Figure 2:
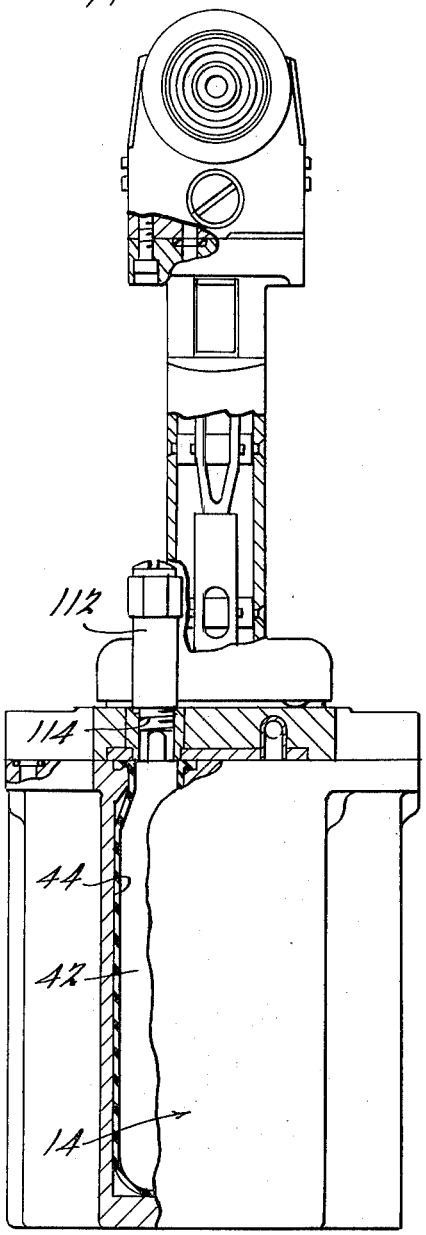
FIG. 2 is a side elevation view, with parts in section, of the tool shown in FIG. 1 and taken substantially in the direction of the Arrow 2.

Referring to the drawings, and referring particularly to FIGS. 1, 2 and 3, a double action pneu-draulic fastener tool is shown. The tool consists of three major subassemblies: the head assembly which includes the pull piston and the shift piston, the handle and piston assembly which includes the triggering system and the pneumatic and hydraulic pistons and the cylinder assembly which includes an adjustable shift valve mechanism. Such a tool is generally that disclosed in the aforesaid VanHecke patent and in the Huck Instruction Manual previously referred to. It is in the construction and arrangement of the shift valve mechanism and its functional relationship with the hydraulic pressure lines so that the shift valve mechanism responds to pressure differentials to directly monitor pressure in the trapped oil circuit and prevent premature shifting of the shift piston to which the present invention is directed.

The head assembly is generally indicated at 10, the handle assembly is generally indicated at 12 and the cylinder assembly is generally indicated at 14.

The head assembly 10 has a pull piston 16 and a shift piston 18 mounted therein for reciprocal movement between a front nose gland 20 and a rear nose gland 22.

The rear face 24 of the shift cylinder 18 is approximately and preferably 35 percent larger than the area of the forward face 26 on the opposite side. Thus, the trapped oil is always intensified by 35 percent over the pull pressure. Suitable nose assemblies are mounted on the forward end of the pull piston in the usual way to accomodate particular fastener diameters and grips.

The handle and piston assembly 12 has a bore 28 therethrough which slideably receives the hydraulic plunger 30. The hydraulic plunger 30 is connected to the air piston 32 by rod 34. The air piston 32 is mounted within a cylindrical bore 36 in the cylinder assembly 14 and the rod slideably projects through a sealed opening through which the rod reciprocates in the operation of the tool.

A shift valve generally indicated at 38 is mounted within a bore 39 of the cylinder assembly housing and such shift valve is adjusted by a shift valve adjustment mechanism generally indicated at 40.

An oil reservoir 42 in the form of a flexible, diaphragm tubular member is mounted within a bore 44 in the cylinder housing in spaced relation to the adjacent wall of the bore 44.

A trigger 46 is mounted on the handle and actuates a four-way valve generally indicated at 48 to operate the installation tool in a manner that will become clear from later descriptions, and generally in the same sequences as in the VanHecke patent and Huck Manual.

With the exception of the detailed construction and arrangement of the shift valve 38 the tool so far described is substantially the same in structure and function as that disclosed in the aforesaid VanHecke patent and Huck Instruction Manual.

Figure 4:
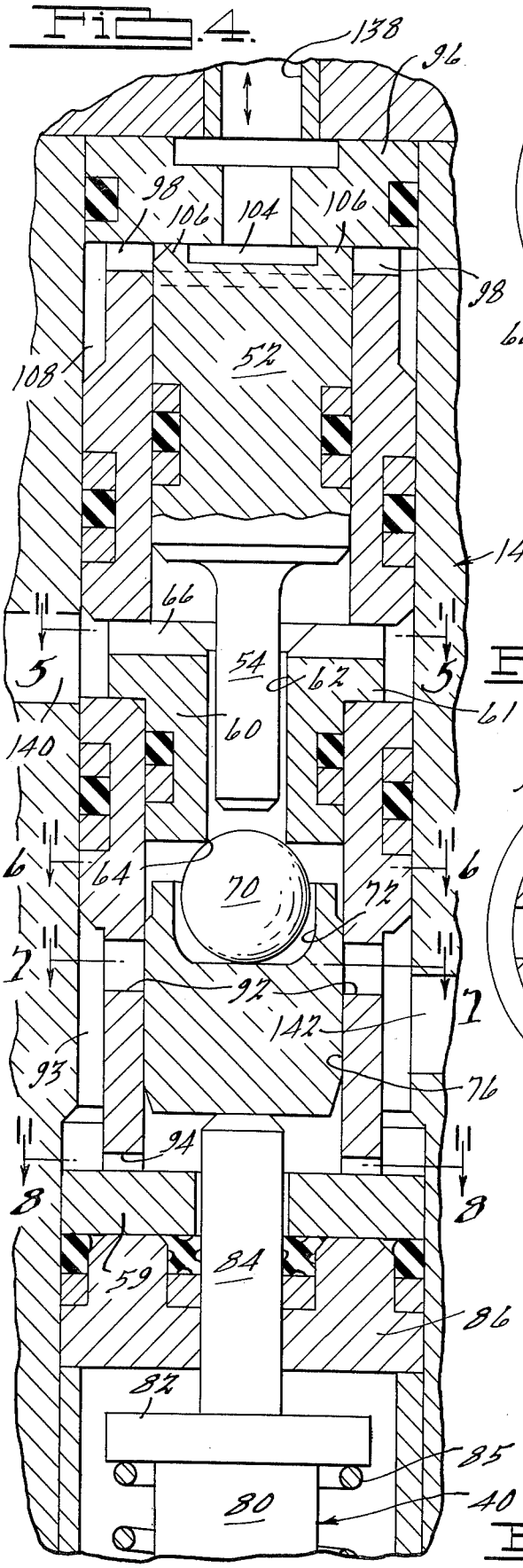
FIG. 4 is an enlarged cross sectional view of the improved shift valve mechanism with the parts in neutral or rest position as related to FIG. 11.
Figure 5:
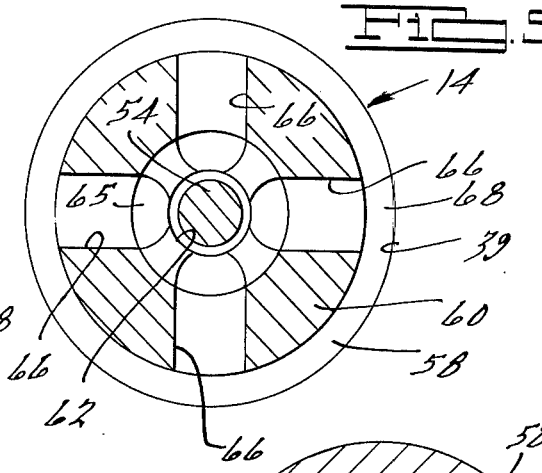
FIG. 5 is a cross sectional view taken substantially along the Line 5—5 of FIG. 4.
Figure 6:
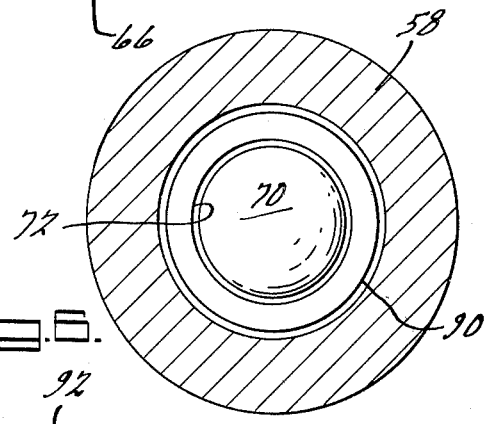
FIG. 6 is a cross sectional view taken substantially along the line 6—6 of FIG. 4.
Figure 7:
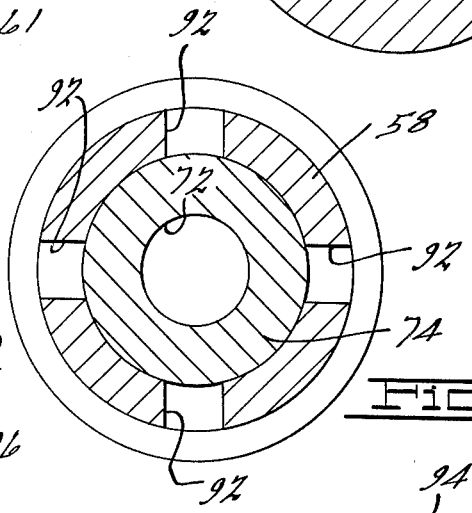
FIG. 7 is a cross sectional view taken substantially along the Line 7—7 of FIG. 4.
Figure 8:
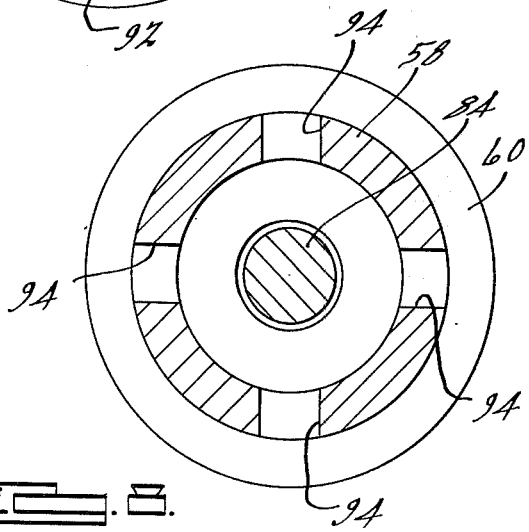
FIG. 8 is a cross sectional view taken substantially along the Line 8—8 of FIG. 4 and showing the shift valve elements in the position related to schematic view FIG. 11.
Figure 9:
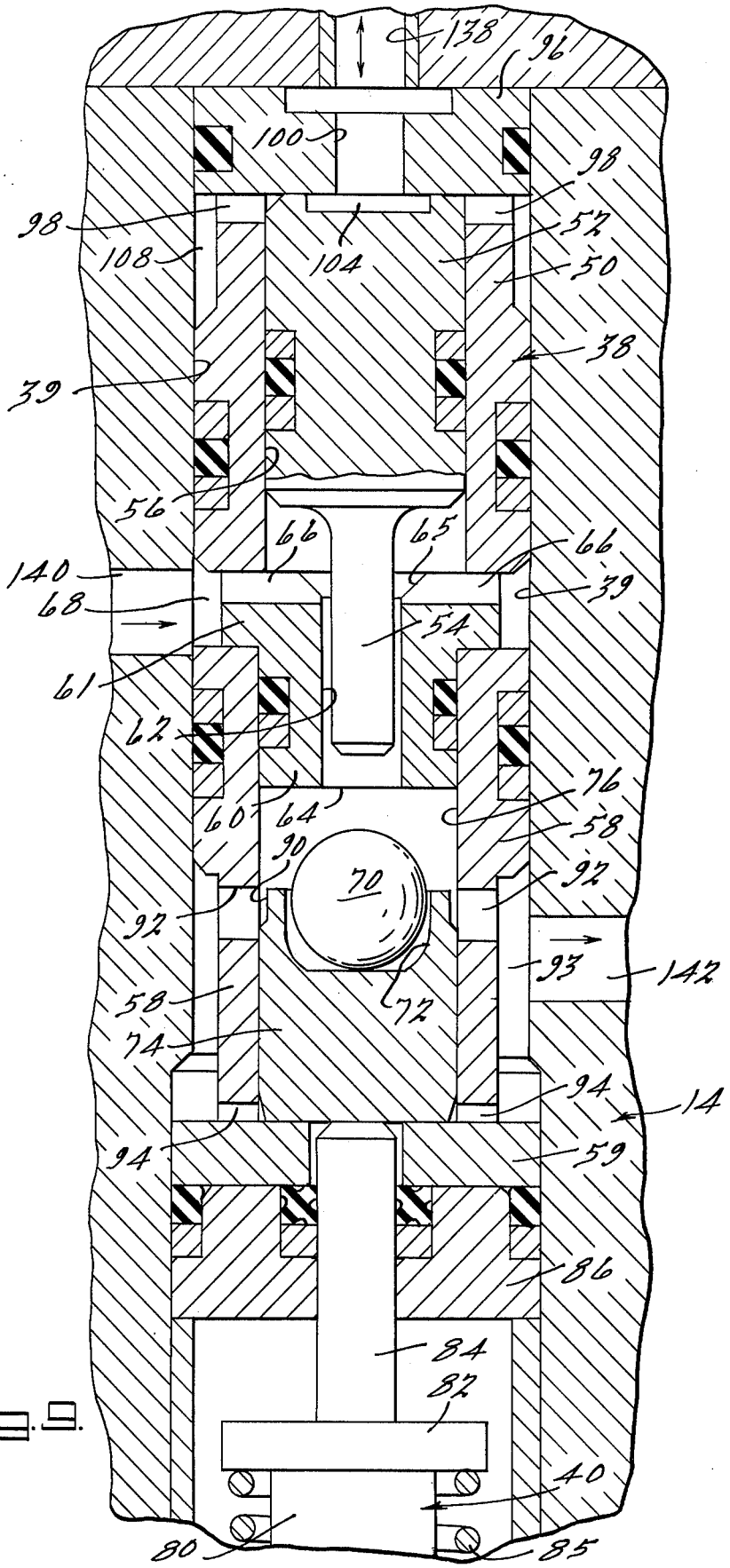
FIG. 9 is a view similar to FIG. 4 showing the shift valve elements in an intermediate position with the trigger depressed and in a position related to schematic view FIG. 12.
Figure 10:
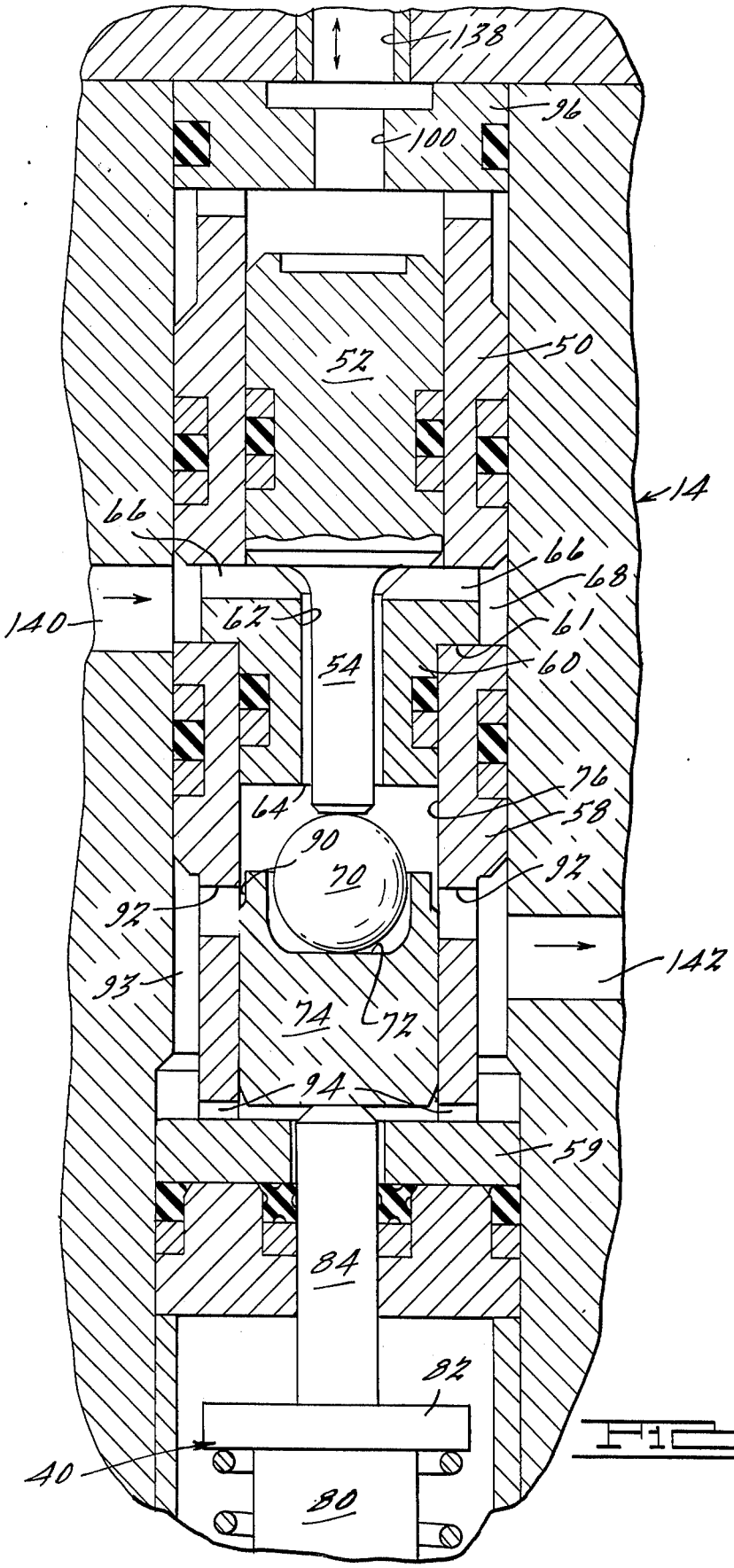
FIG. 10 is a view similar to FIG. 4 and showing the valve elements in a final power position with the trigger depressed and in a position related to schematic view FIG. 13.

The detailed construction of the shift valve is best shown in FIGS. 4 through 8 and illustrated in different positions in FIGS. 4, 9 and 10.

The shift valve 38 comprises an upper sleeve 50, a plunge 52 and a depending integral and centrally located stem 54 mounted within a bore 56 in the upper sleeve 50 for reciprocal movement therein.

A lower sleeve 58 is also mounted within the bore 39 and rests upon valve seat 60 which is mounted within the housing 14.

A valve seat member 60 has an annular flange 61 at the upper end which rests on the upper surface of the lower sleeve 58. The valve seat has a central opening 62 therethrough the lower end of which defines a valve seat 64. The upper end of the seat 60 terminates in a tapered opening 65 which has radial passages 66 formed therein communicating adjacent their inner ends with openings 65 and 62 and communicating at their outer ends with an annular space 68 formed around the periphery of the seat 60 and between the facing surfaces of the upper sleeve 50 and the lower sleeve 58. The depending stem 54 extends within the opening 62 for a movement therein in a manner and for a function to be hereinafter described.

A ball 70 loosely seats within an upwardly opening recess 72 in a ball guide 74.

The ball 70 is adapted to seat against the valve seat 64 (FIG. 8) to prevent the upward flow of hydraulic fluid therethrough, when in one position and to be moved away from the seat 64 by hydraulic fluid in another position (FIG. 9) to permit initial downward fluid flow and momentarily thereafter be held away from the seat 64 by the depending stem 54 when in another position (FIG. 10).

Figure 11:
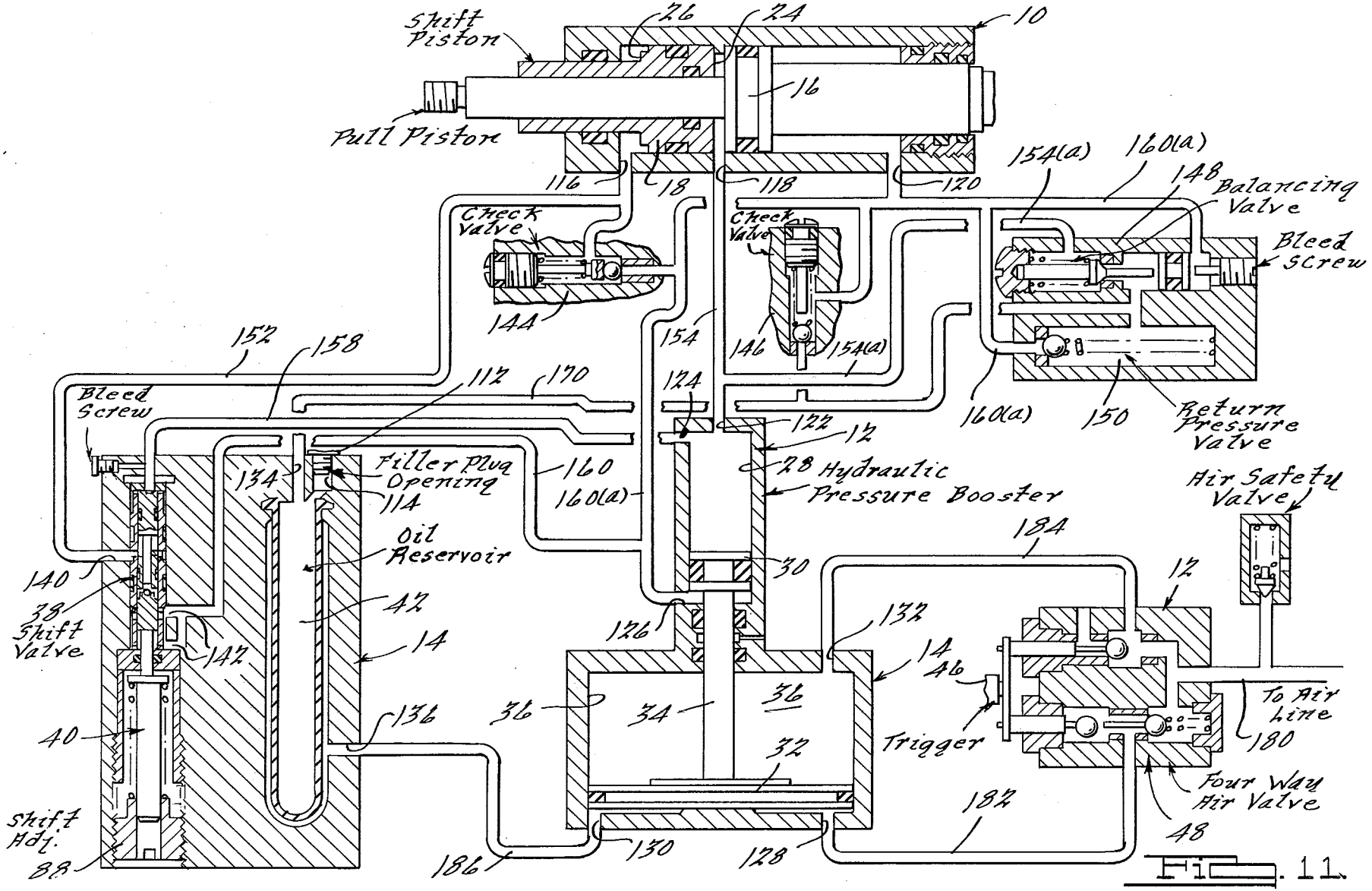
FIG. 11 is a schematic fluid circuit diagram for the tool of the present invention as illustrated in the figures previously described, with the trigger not depressed and with the pull and shift pistons shown in rest position and the shift valve positioned as in FIG. 4.

The ball guide 74 is vertically movable within the bore 76 of the lower sleeve and is vertically adjustable so as to precisely adjust the resistance of the movement of the ball 70 with respect to the valve seat 64. This is accomplished by the shift valve adjustment mechanism 40. Such mechanism 40 includes a depending central cylindrical member 80 having an annular flange 82 at the upper end and an upwardly extending integral pin 84 which extends through a sealed opening in the cap 86 and through a central opening in the spacer 59 to engage the undersurface of the ball guide 74. A valve spring 85 embraces the cylindrical member 80 and bears against the underside of the flange 82 urging the pin 84 upwardly against the abutting undersurface of the ball guide. The lower end of the spring is engaged by an adjustable screw 88 (FIGS. 1 and 11). By adjusting the screw 88 the spring pressure of the stem 84 against the undersurface of the ball guide 74 is adjusted so as to precisely adjust the resistance of movement of the ball 70 with respect to the valve seat and particularly to adjust the resistance to move the ball away from the seat.

The upper end of the ball guide 74 has an annular reduced portion 90 at the upper end so as to provide passage for oil flow to adjacent ports as will be more apparent from the following description.

The lower sleeve 58 is provided with a plurality of radial ports 92 intermediate the ends thereof and also with corresponding radial slots 94 adjacent the lower end thereof.

A cap 96 is disposed within the bore 39 adjacent the upper end and seats on the top of the upper sleeve 50. The adjacent top portion of the sleeve 50 is formed with a pair of diametrically opposed radial passages 98. The cap 96 is formed with a central cylindrical port or passage 100 therethrough which communicates at its lower end with the bore 39. The top of plunger 52 is formed with a transverse slot 104 which forms a pair of transverse ridges 106. Such ridges 106 serve to prevent flat area, metal to metal contact between the top of the plunger 52 and the faying surface of the cap 96 around the port 100 to insure easy oil flow.

The upper end of the sleeve 50 has a reduced O.D. to provide an annular chamber 108 with which the passages 98 communicate. Communication with the chamber may be had by removing screw 110 (FIG. 1) and applying a pressure gauge to test the fluid pressure in the line.

Suitable seals, usually "O"-rings, are disposed on the various elements described and shown so as to seal the flow of fluid between adjacent surfaces as would be evident to those skilled in the art.

An air collector tube 112 is attached at the filler plug opening 114 (FIGS. 2 and 11). This permits any entrapped air circulating back to the reservoir to drift away from the reservoir supply opening. This precludes air entering the reservoir from being reintroduced to the system on the next stroke. Thus, this air collector allows the tool to self-bleed small quantities of air while installing fasteners.

The required ports and conduits for the oil and air passages are formed in the housings for the head assembly, the handle and piston assembly and the cylinder assembly as in the VanHecke patent and Huck Manual previously referred to. Also the bores for locating the check valves, the balancing valve, the return pressure valve, the four-way operating valve and the air safety valve are likewise formed and arranged in the same manner as in these prior references.

Figure 12:
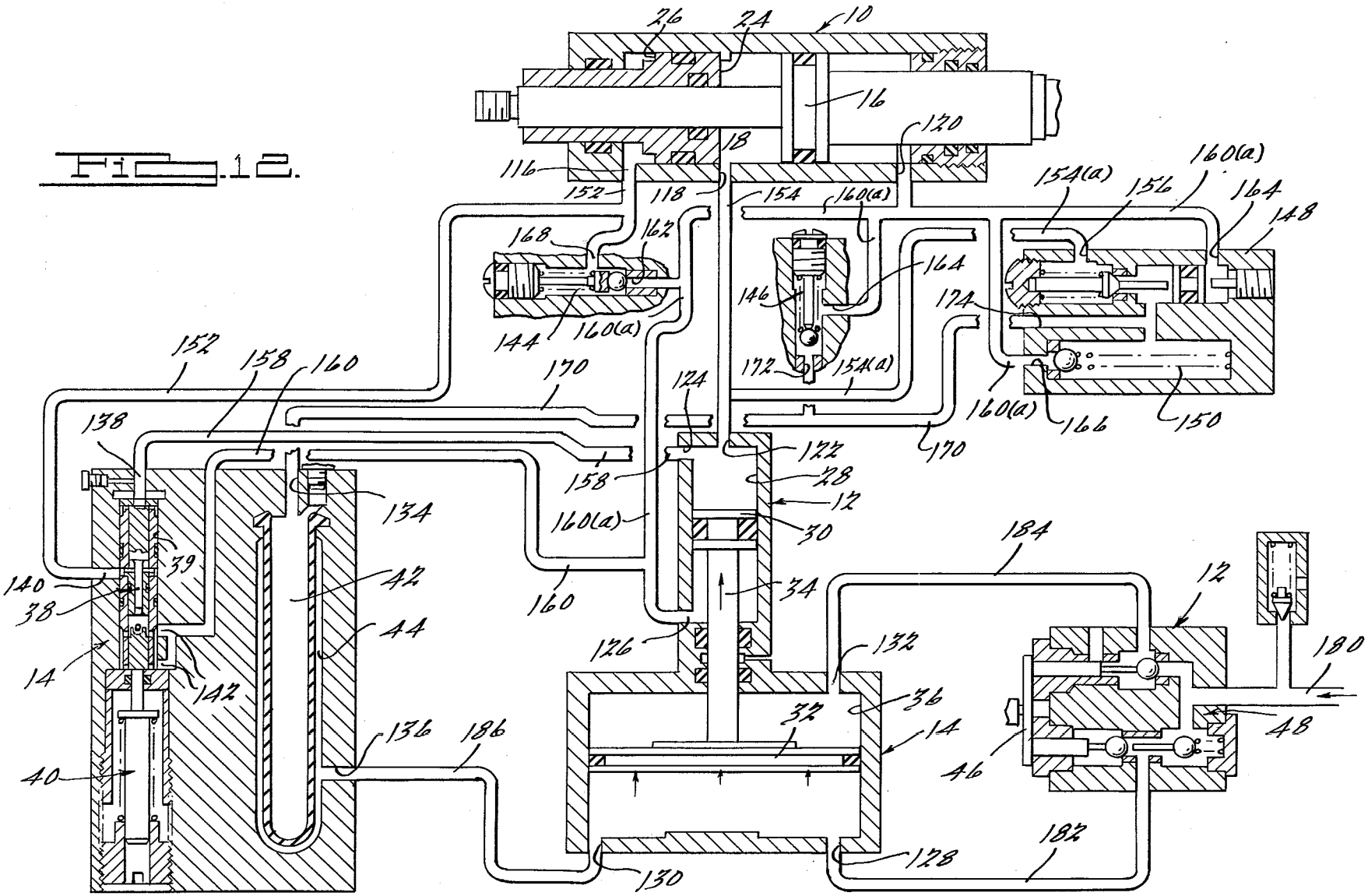
FIG. 12 is also a schematic view similar to FIG. 11, with the trigger depressed, with the pull and shift pistons as well as the air cylinder and hydraulic cylinder at intermediate positions of their strokes and the shift valve positioned as in FIG. 9.
Figure 13:
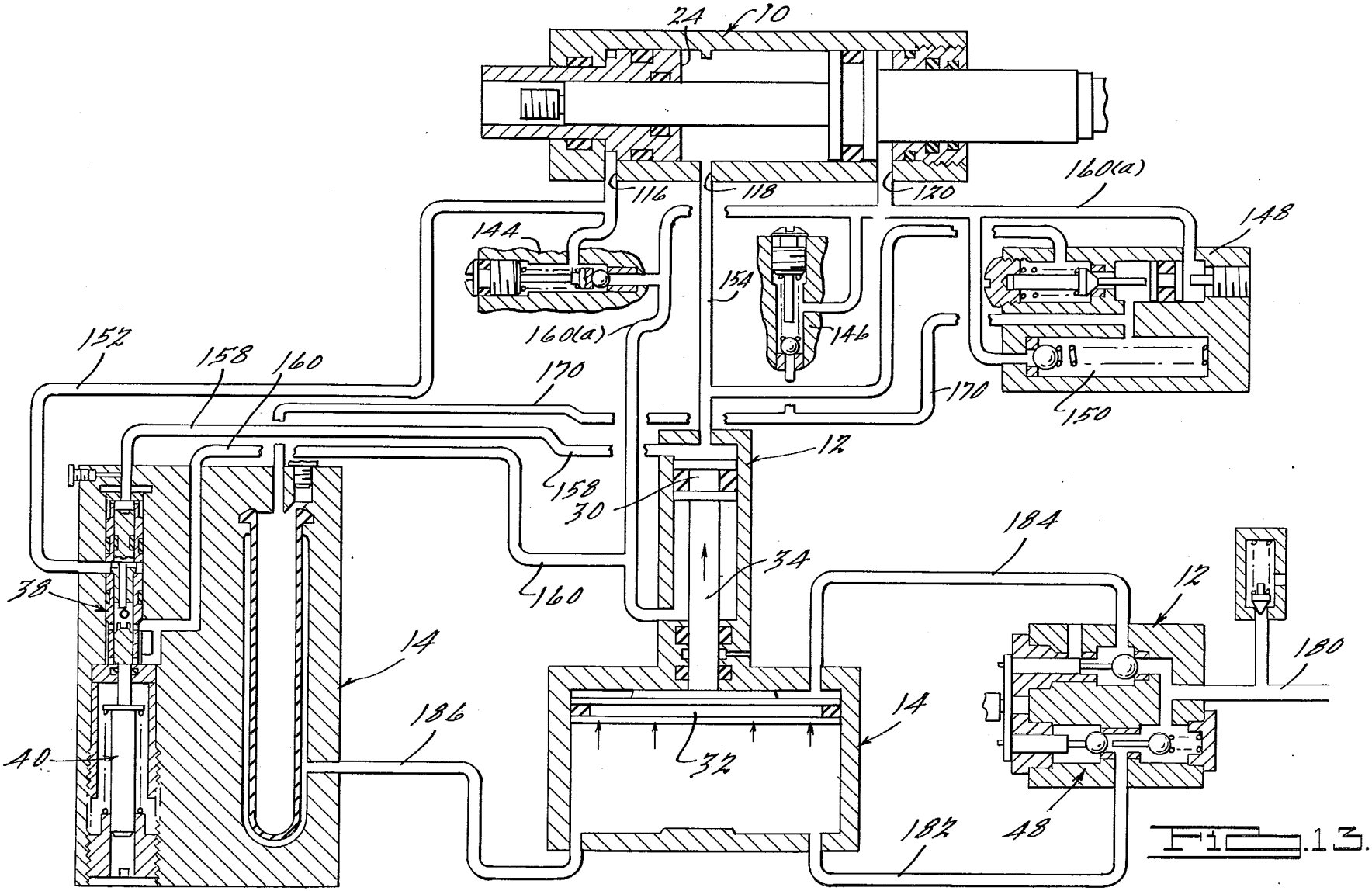
FIG. 13 is also a schematic view similar to FIG. 12, with the trigger depressed, at the end of the stroke of the pull and shift pistons as well as the air and hydraulic pistons, and with the shift valve positioned as in FIG. 10.

The construction and function of these elements may best be understood by reference to the schematic drawings FIGS. 11, 12 and 13 as related to their corresponding shift valve drawings FIGS. 4, 9 and 10, respectively.

The head assembly is provided with a port 116 adjacent to the forward end of the head and forwardly of the shift piston, a port 118 intermediate the ends of the head and between the shift piston and the pull piston, and a port 120 adjacent the end of the head and behind the pull piston 16.

Communication with the bore 28 of the hydraulic piston is provided through ports 122 and 124 adjacent the top of the bore and forwardly of the leading end of the piston 30. A port 126 is provided adjacent the lower end of the bore 28 and on the back or underside of the piston 30.

Ports 128 and 130 are provided in the housing of the cylinder assembly and at the lower end of the cylinder bore 36 and under the piston 32. Another port 132 is provided in the cylinder assembly adjacent the top of the bore 36.

That part of the cylinder assembly which houses the shift valve and the oil reservoir is provided with ports 134 and 136, the port 134 communicating with the open top of the oil reservoir 42 and the port 136 communicating with the space 44 surrounding the flexible reservoir 42.

A port 138 is provided which communicates with the top of the bore 39. A port 140 also communicates with the bore 39 adjacent the passages 66 in the shift valve (FIG. 4). Another port 142 also communicates with the bore 39 adjacent the port 92 and the surrounding space 93.

Check valves 144 and 146 and balancing valve 148 and return pressure valve 150 are provided in the head assembly.

These portings and the check valves, balancing valve, return pressure valve and the four-way valve are substantially the same as in the VanHecke patent and Huck Manual referred to. Their operations and functions are also substantially the same.

The conduits connecting the ports are also substantially the same and are identified as follows:

Conduit 152 connects port 116 with port 140. Conduit 154 connects port 118 with port 122 and branch conduit **154*a* connects conduit 154 with port 156** of the balancing valve.

Conduit 158 connects port 138 of the shift valve with port 124 of the hydraulic piston.

Conduit 160 connects port 126 with the port 142 of the shift valve and open branch conduit **160*a* also connects ports 126 and 142 with a port 162 of the check valve 144 and with a port 164 of check valve 146. Conduit 160*a* also communicates with port 164 of the balancing valve 148 and port 166 of the return pressure valve 150**.

Conduit 152 communicates with check valve 144 through port 168.

Port 134 which communicates with the oil reservoir 42 communicates through conduit 170 with port 172 of the check valve 146 and with port 174 of the balancing valve 148.

The description of the conduits thus far relates to the hydraulic system which is a closed system and with the conduits and piston cylinders completely full of hydraulic fluid at all times.

Air pressure is provided from a suitable source to the four-way valve 12 through conduit 180. The four-way valve 12 acts as in the prior references when depressed to provide air under pressure by conduit 182 communicating with port 128. When the trigger is depressed, this acts on the underside of the air piston 32 to force it upwardly and to force the piston 30 upwardly.

A conduit 184 connects the four-way valve 12 with the port 132 and the chamber 36 above the piston 32.

Port 130 in the bottom of the air cylinder connects with the port 36 by conduit 186 and air under pressure is thus provided around the flexible diaphragm oil container 42 to assure that the oil system is completely filled.

Referring to FIGS. 4 and 11, the trigger is open and the system is full of hydraulic fluid and all parts are in neutral or rest position. That is, the pull piston 16 is to the left of its housing and the shift piston 18 is to the right of its housing, viewing FIG. 11. The ball 70 is against the valve seat 64, out of contact with the stem 54 of the plunger 52. The ball guide has been properly adjusted by adjusting the shift adjuster 40 so that the ball will be held against the seat 64 against fluid pressure in the chamber surrounding the ball tending to move it and the valve guide away from the valve seat 64 and against the action of the spring 85 from the pressure exerted against the top of the ball from the fluid pressure in conduit 152 through port 140, passages 66 and in space around the stem 54 within the opening 62 of the valve seat.

At that time there is no air pressure acting upon the air plunger 32 and consequently no pressure exerted on the oil within the chamber 28 by the hydraulic piston 30.

When the trigger 46 is depressed, air under pressure passes through the four-way valve into the underside of the chamber 36 through conduit 182 and port 128. That same air pressure acts through port 130 and conduit 186 and port 136 to place the diaphragm 42 under pressure and assure that the system is full of oil.

As the air piston 32 moves upwardly, the hydraulic piston 30 correspondingly moves up forcing hydraulic fluid under pressure through conduit 154 and into the pull piston chamber forwardly of the pull piston as shown in FIG. 12 to cause the pull piston to move to the right, viewing FIG. 11. As the piston 16 pulls the fastener, it will meet resistance at a predetermined point in the setting of the fastener so that the pressure within the pull piston chamber forwardly of piston builds up to act against the rear face 24 of the shift piston. As this pressure builds up, the build up force is in direction to move the shift piston toward the left (viewing FIG. 12) and because of the differential in the area of the faces 24 and 26 the pressure forwardly of the shift piston will be increased by approximately 35 percent greater than the pressure in the chamber behind the shift piston. This higher pressure acts through port 116, conduit 152, port 140 and passages 66. That increased pressure within acts against the top of the ball valve 70 in the area around the stem 54. Referring to FIG. 9 and FIG. 12, the pressure has thus built up to cause the shift piston to move forward and to cause the ball 70 to move away from its seat. However, at this stage the plunger 52 has not moved as yet, but will move downward momentarily. During this very short time, the pressure within the lower sleeve, under the seat 60 will cause the fluid to move in the space 90, out the passages 92, through the port 142 and into the conduit 160.

The pressure will then drop under the plunger 52 and as the hydraulic plunger 30 continues in its upward movement hydraulic fluid is forced through port 124, conduit 158 and port 100. This pressure acting against the top of the plunger 52 will cause the stem 54 to engage the ball 70 holding it away from the valve seat 64, as shown in FIGS. 10 and 13.

The valve parts will be held in this position until the driving cycle has been completed, i.e. until the fastener is completely set.

At that time the trigger 46 is released and returned to its original "at rest" position shown in FIG. 11. The shift valve elements at the same time are returned to the position shown in FIG. 4. The check valve 144 and the balancing valve only open on the return stroke of the pull piston. This return movement and the movement of the oil pressure are the same as in the prior VanHecke patent and Huck Manual. This is also true of the four-way valve 48 which is spring returned to its original position as shown in FIG. 11 when the trigger is released.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A fastener installation tool of the fluid actuated pull gun type comprising in combination, a head assembly including a pull piston and a shift piston, a handle and piston assembly including a hydraulic piston and an air piston directly connected thereto and trigger means for actuating a fluid circuit, a cylinder assembly including an air cylinder for receiving said air piston and shift valve means, said fluid circuit being constructed and arranged for the supply of fluid under pressure upon actuation of said trigger to first said pull piston to cause pulling of a fastener and upon a predetermined pressure build up cause said shift piston to move forward to set the fastener, said shift valve being constructed and arranged in said circuit to be operable upon said predetermined pressure build up to cause said shift piston movement, said fluid circuit including a trapped fluid circuit between the forward face of said shift piston and said shift valve, and said shift valve including a ball valve held against a valve seat until said predetermined pressure is reached and arranged in said circuit to prevent shifting of said shift piston until unseated by said predetermined pressure, said trapped fluid circuit pressure responding to said pressure build up to unseat said ball valve and thereby relieve the trapped fluid pressure forward of said shift piston to permit said shift piston to move forward to set the fastener.

2. A fastener installation tool according to Claim 1 in which said shift valve includes a plunger having a depending stem, movement of said plunger being controlled to cause said stem to contact said ball and hold said ball away from its valve seat momentarily after unseating of said ball valve.

* * * * *